US006246853B1

(12) United States Patent
Suzuki et al.

(10) Patent No.: US 6,246,853 B1
(45) Date of Patent: Jun. 12, 2001

(54) TONER CONTAINER, DEVELOPMENT CARTRIDGE, AND PROCESS CARTRIDGE

(75) Inventors: Akira Suzuki, Odawara; Kenshiro Abe, Ibaraki-ken; Shinichi Sasaki; Kouji Hashimoto, both of Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/386,478

(22) Filed: Aug. 31, 1999

(30) Foreign Application Priority Data

Aug. 31, 1998 (JP) ..... 10-260919

(51) Int. Cl.[7] ..... G03G 21/16; G03G 15/08

(52) U.S. Cl. ..... 399/262; 399/111

(58) Field of Search ..... 156/60, 94, 325, 156/326, 329, 330; 347/36; 399/111, 262, 263; 217/56

(56) References Cited

U.S. PATENT DOCUMENTS

| | | | |
|---|---|---|---|
| 5,126,800 | 6/1992 | Shishido et al. | 355/211 |
| 5,134,441 | 7/1992 | Nagata et al. | 355/245 |
| 5,151,734 | 9/1992 | Tsuda et al. | 355/200 |
| 5,223,893 | 6/1993 | Ikemoto et al. | 355/200 |
| 5,294,960 | 3/1994 | Nomura et al. | 355/210 |
| 5,345,294 | 9/1994 | Nomura et al. | 355/200 |
| 5,463,446 | 10/1995 | Watanabe et al. | 355/200 |
| 5,485,249 | 1/1996 | Higeta et al. | 355/210 |
| 5,500,714 | 3/1996 | Yashiro et al. | 355/200 |
| 5,543,898 | 8/1996 | Shishido et al. | 355/210 |
| 5,550,617 | 8/1996 | Odagawa et al. | 355/210 |
| 5,581,325 | 12/1996 | Tsuda et al. | 355/200 |
| 5,585,902 | 12/1996 | Nishiuwatok et al. | 355/260 |
| 5,617,579 | 4/1997 | Yashiro et al. | 399/114 |
| 5,623,328 | 4/1997 | Tsuda et al. | 399/111 |
| 5,640,650 | 6/1997 | Watanabe et al. | 399/117 |
| 5,689,774 | 11/1997 | Shishido et al. | 399/111 |
| 5,740,500 | 4/1998 | Hashimoto | 399/114 |
| 5,768,660 | 6/1998 | Kurihara et al. | 399/111 |
| 5,812,909 | 9/1998 | Oguma et al. | 399/103 |
| 5,828,928 * | 10/1998 | Sasago et al. | 399/111 |
| 5,864,731 | 1/1999 | Ikemoto et al. | 399/27 |
| 5,870,654 | 2/1999 | Sato et al. | 399/109 |
| 5,923,918 | 7/1999 | Nakagawa et al. | 399/27 |
| 5,923,924 | 7/1999 | Hashimoto | 399/111 |
| 5,937,237 | 8/1999 | Nonaka et al. | 399/106 |
| 5,966,567 | 10/1999 | Matsuzaki et al. | 399/111 |
| 6,009,289 | 12/1999 | Sekine et al. | 399/113 |
| 6,014,534 * | 1/2000 | Goebel et al. | 399/106 |
| 6,075,962 * | 6/2000 | Seguchi et al. | 399/262 |

* cited by examiner

*Primary Examiner*—Arthur T. Grimley
*Assistant Examiner*—Hoang Ngo
(74) *Attorney, Agent, or Firm*—Fitzpatrick, Cella, Harper & Scinto

(57) ABSTRACT

A toner container usable with an electrophotographic image forming apparatus, for containing toner, the toner container includes a first frame of plastic resin material; a second frame of plastic resin material; a bonding portion where the first and second frames are connected with each other by bonding material; a fitting portion, adjacent the connecting portion, where a projection provided in the second frame is fitted into a pit provided in the first frame.

33 Claims, 8 Drawing Sheets

| | | EMB. | COMP. EX. |
|---|---|---|---|
| | RUBBER REINFORCED STYRENE RESIN | 100 | 100 |
| 61 | ETHYLENEBISPENTABROMODIPHENYL | 10 | — |
| 62 | TBA DERIVATIVE | — | 10 |
| | MOLDING TEMP. 1ST MOLDING<br>2ND MOLDING | 220<br>240 | 220<br>240 |
| | GAS PRODUCTION AT MOLDING | NO | YES |
| | DROP TEST | OK | NG |
| | BINDING STRENGTH (1ST & 2ND MOLDING) | OK | NG |

SET TEMP. OF HOT LINER

RESULT OF PRESS. REDUCTION TEST ($85 g/cm^2$)

FIG. 7

| | STRUCTURAL FORMULA | BROMINE CONTENT (%) | MELTING POINT (°C) | 5% TGA TEMP. |
|---|---|---|---|---|
| 62<br>DBP-TBA<br>BIS(DIBROMOPROPYL) TETRABROMOBISPHENOL A ETHER |  | 68 | 108 | 290 |
| 61<br>BPBPE<br>BIS(PENTABROMOPHENYL) ETHANE |  | 82 | 354 | 390 |

TONER CONTAINER, DEVELOPMENT CARTRIDGE, AND PROCESS CARTRIDGE

FIELD OF THE INVENTION AND RELATED ART

The present invention relates to a toner cartridge, a development cartridge, and a process cartridge, which are used in an electrophotographic image forming apparatus.

The term "process cartride" refers to a cartridge which is removably installable in the main apparatus of an image forming apparatus, and integrally comprises an electrophotographic photosensitive member, a charging means, and either a developing means or a cleaning means. The combination of the components in the cartridge may be a combination composed of an electrophotographic photosensitive member, and at least a charging means, a developing means, or cleaning means, or a combination composed of an electrophotographic photosensitive member, and at least a developing means.

A term "electrophotographic image forming apparatus" refers to an image forming apparatus, for example, a laser printer or a copying machine, which employs an electrophotographic system.

First, referring to FIG. 3, a sectional view, a conventional color laser printer will be described. In FIG. 3, a reference character 105 designates a rotational developing apparatus. This rotational developing apparatus 105 holds developing devices 105M, 105C, 105Y, and 105B, which correspondingly hold magenta, cyan, yellow, and black toners. These four developing devices 105M, 105C, 105Y, and 105B for four different colors are disposed around a shaft 105*e*, enabled to be orbitally moved about the shaft 105*e*. The attitudes of the four developing devices are kept in the predetermined attitude by a driving structure which resembles a planetary gear system. In an image forming operation, the developing devices 105M 105C, 105Y, and 105B, which contain toners of different color, are individually moved to the position (development station) at which a developing device opposes the image bearing member 105, leaving a microscopic gap between the peripheral surface of the development roller 105*b* and image bearing member 104.

At the development station, as bias is applied to the development roller 105*b* while it is rotationally driven, a latent image on the image bearing member 104 is developed into a visible image (hereinafter, "toner image") composed of toner.

The development roller 105*b* is disposed in each developing device (105M, 105C, 105Y, and 105B) in contact with a supply roller 105*a*, which scrapes off the developer (residual toner), which did not contribute to the latent image development, so that the development roller 105*b* can bear a fresh supply of developer. A container which holds the toner to be supplied to the development roller 105*b* is an integral part of each developing device (105M, 105C, 105Y, and 105B). At this point, a conventional toner container will be described.

FIG. 6 is a sectional view of a conventional toner container 40. A portion designated by a reference character B is a part of the joint at the longitudinal ends of the toner container. This toner container essentially consists of a piece 42, the main piece, and a piece 41, the lid or cover. The two pieces are united with each other at the interface 46 by pouring resin formulated for joining, into the grooves 143*a*, 143*b*, and 143*c*, which are formed outside the interface 46 as the two pieces are joined. The main piece 42, the lid 41, and the joining resin are formed of high-impact polystyrene (hereinafter, "HI-PS") in which fire-retardant is mixed to make the container fire resistant.

As for the fire retardant for the main and lid pieces 41 and 42, and the joining resin, a derivative of tetrabromobisphenol A (bis (dibromopropyl) tetrabromobisphenol A ether) is used, the details of which are given in FIG. 8, (a).

However, the toner container design described above suffers from-the following problems:

1. The plane of the surface to which adhesive resin adheres coincides with the plane of the interface between the main and lid pieces of the toner container, making the toner container easy to break. More specifically, the toner container may be subject to the shocks which are generated as it is dropped during its shipment. Also it may be subjected to internal pressure change, and the like. In such cases, the force generated by the shocks, internal pressure, or the pressure generated by the toner itself, directly apply to the interface between the two pieces due to the way the two pieces are constructed. As a result, the two pieces may be become separated; the toner container may break.

2. The grooves which are created as the main and lid pieces of the toner container are joined, that is, the grooves in which the adhesive filler resin is poured has a cross sectional size of 1–5 mm×1–5 mm, and the resin must be evenly poured into the grooves that extend along the interface. Therefore, the HI-PS requires a high degree of fluency. In order to give the HI-PS the high degree of fluency, the level to which the temperature of the adhesive filler resin is set during the manufacture of the toner container must be set at a level higher than the normal level. As a result, the fire retardant becomes separated from the adhesive filler resin, forming gas. This gas remains, in the form of a bubble, between the surfaces to be joined, and reduces the effectiveness of the adhesive filler resin.

SUMMARY OF THE INVENTION

The primary object of the present invention is to provide a toner container, a development cartridge, and a process cartridge, that consist of two or more components (sub-frames) joined together.

Another object of the present invention is to provide a toner container, a development cartridge, and a process cartridge, the sub-frames of which do not easily separate from each other.

Another object of the present invention is to provide a toner container, a development cartridge, and a process cartridge, that are designed so that the strength of the adhesive placed at the interface between the opposing sub-frames does not weaken.

According to an aspect of the present invention, a toner container, a development cartridge and a process cartridge, each comprises first and second sub-frames with a flange, and the flange of the first frame consists of a portion (margin) for adhesive and a portion with a groove, whereas the flange of the second sub-frame consists of a portion (margin) for adhesive and a portion with a tongue that fits into the groove of the flange of the first sub-frame.

According to another aspect of the present invention, a toner container, a development cartridge, and a process cartridge each comprises two sub-frames that can be adhered together by injecting melted adhesive into the joint formed as the two components are fitted with each other.

BRIEF DESCRIPTION OF THE DRAWINGS

FIG. 7 is a table that presents the results of the evaluations of a toner container in accordance with the present invention, and a conventional toner container.

DESCRIPTION OF THE PREFERRED EMBODIMENTS

Hereinafter, an embodiment of the present invention will be described with reference to the appended drawings.

Figure 2:
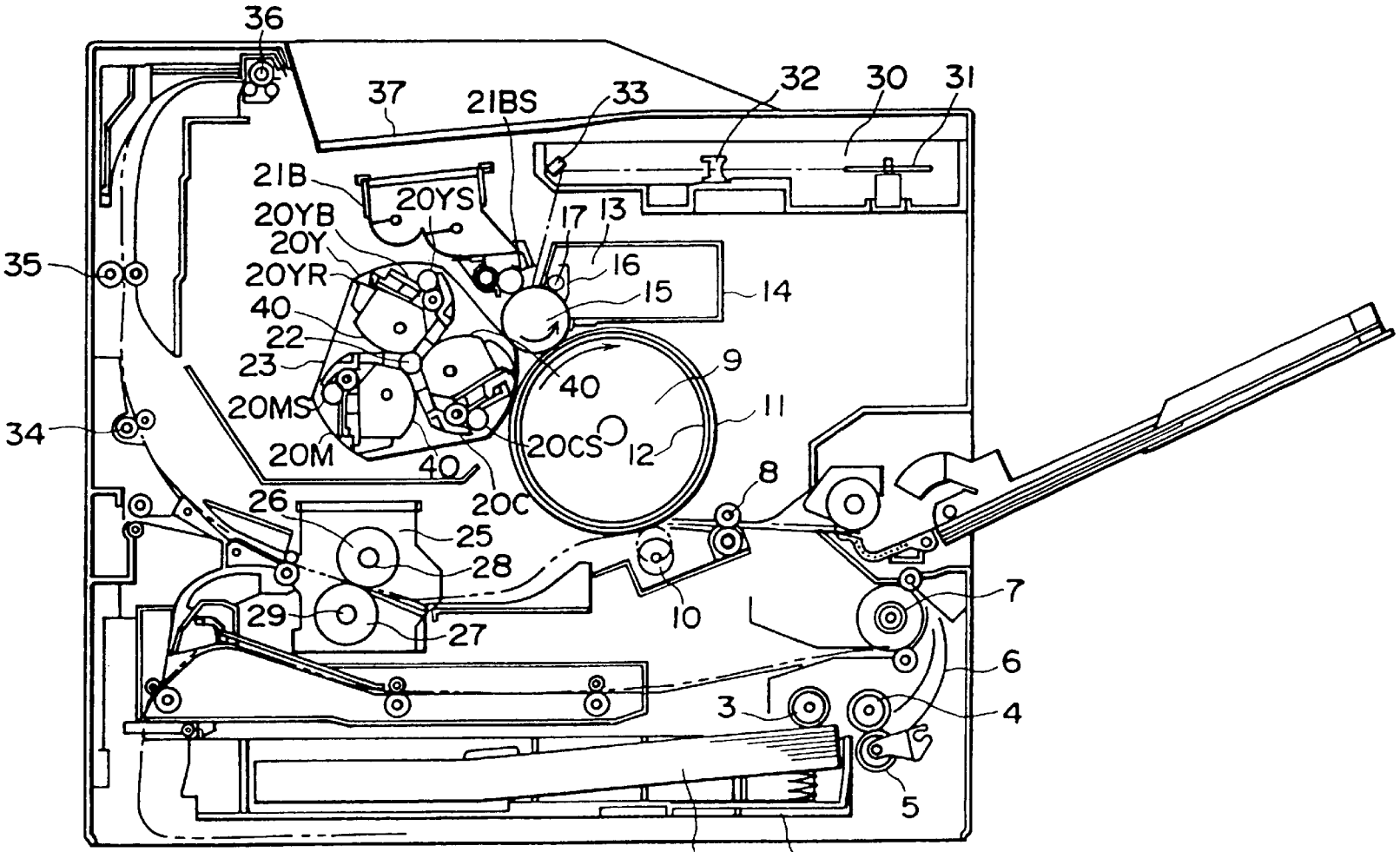
FIG. 2 is a schematic vertical sectional view of a color laser printer equipped with toner containers in accordance with the present invention.
Figure 3:
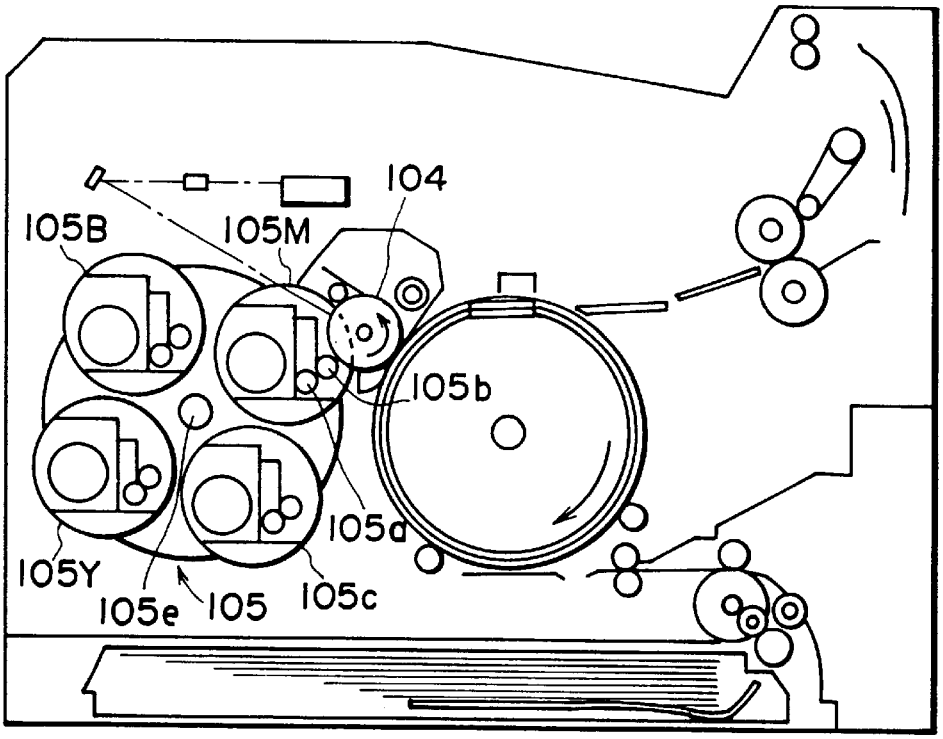
FIG. 3 is a schematic vertical sectional view of a color laser printer equipped with a conventional toner container.

First, referring to FIG. 2, the general structure of a color image forming apparatus will be described. FIG. 2 is a sectional view of a color laser printer, a form of a color image forming apparatus.

The color laser printer in FIG. 2 comprises an image forming section that consists of a photosensitive drum 15, a nonchromatic developing device 21B (hereinafter, "black developing device"), and three color developing devices 20Y, 20M, and 20C. The photosensitive drum 15 is an image bearing member, and rotates at a predetermined constant velocity. The black developing device 21B is fixed, but three color developing devices are orbitally movable. Monochromatic toner images individually formed (developed) in the image forming station are transferred in layers onto a transfer medium 2 conveyed from a transfer medium feeding section. After receiving the full-color image composed of the monochromatic toner images, the transfer medium 2 is conveyed to a fixing apparatus 25, in which the full-color image is fixed to the transfer medium 2. Thereafter, the transfer medium 2, which now bears the fixed full-color image, is discharged by discharge rollers 34–36 into a delivery section located at the top of the image forming apparatus. The color developing devices 20Y, 20M, and 20C, which are orbitally movable, and the black developing device 21B, which is fixed, can be individually installed into, or removed from the main assembly of the printer.

Next, the structure of each of the various section and components of the color laser printer will be described in detail in the logical order.

A process cartridge 13 integrally comprises the photosensitive drum 15 and a cleaning means housing 14. The latter doubles as the frame for supporting the photosensitive drum 15. This process cartridge 13 is removably supported within the main assembly of the image forming apparatus (printer), so that it can be easily replaced according to the service life of the photosensitive drum 15. The process cartridge 13 is provided with a pair of guides that engages, one for one, with a pair of grooves (guides) with which the main assembly of the printer is provided, and slides thereon. It can be removed from the main assembly by pulling it rightward of FIG. 2, and can be installed into the main assembly by pushing it leftward. In some cases, the main assembly of the printer is provided with a device in the form of a drawer, in which the process cartridge 13 can be placed to be installed into or removed from the main assembly.

The photosensitive drum 15 in this embodiment consists of an aluminum cylinder with a diameter of approximately 62 mm, and a layer of organic photoconductor coated on the peripheral surface of the aluminum cylinder. It is rotationally supported by the cleaning means housing 14, that doubles as the holder for the photosensitive drum 15. Adjacent to the photosensitive drum 15, a cleaning blade 16 and a means 17 for primary charge are disposed in contact with the peripheral surface of the photosensitive drum 15. As the driving force from an unillustrated motor is transmitted to the rear end, in terms of the surface of FIG. 2, of the photosensitive drum 15, the photosensitive drum 15 is rotationally driven in the direction (counterclockwise) indicated by an arrow mark in the drawing in synchronism with the progress of each image forming operation.

[Charging Means]

The charging means 17 for primary charge is a charging means that employs a contact type charging system. More specifically, it comprises an electrically conductive roller, which is placed in contact with the photosensitive drum 15 so that the peripheral surface of the photosensitive drum 15 is uniformly charged as electrical voltage is applied to this electrically conductive roller.

[Exposing Means]

The photosensitive drum 15 is exposed by a scanner portion 30. More specifically, as image forming signals are given to a laser diode, the laser diode emits a beam of light, which is modulated with the image forming signals, toward a polygon mirror 31, which is being rotated at a high velocity by a scanner motor.

The beam of light is deflected by the polygon mirror 31, passes through a focusing lens 32, is deflected by a mirror 33, and exposes the peripheral surface of the photosensitive drum 15. which is rotating at a predetermined constant velocity, according to the image forming signals. As a result, an electrostatic latent image is formed on the photosensitive drum 15.

[Developing Means]

The developing means is a means for visualizing the aforementioned electrostatic latent image. It consists of three color developing devices 20Y, 20M, and 20C, and a black developing device 21B. They make it possible to develop the electrophotographic latent image into a visible image composed of yellow, magenta, yellow, or black toners, correspondingly.

The black developing device 21B is a device that is stationary relative to the main assembly of the image forming apparatus. It is disposed at a position at which its development roller 21BS squarely faces the photosensitive drum 15, holding a microscopic gap (approximately 300 $\mu$m from the peripheral surface of the photosensitive drum 15. This black developing device 21B forms a visible image, that is, an image composed of black toner, on the peripheral surface of the photosensitive drum 15.

Each of the three color developing devices 20Y, 20M, and 20C contains toner, the amount of which is equivalent to 6,000 pages of printing on A4 size (JIS) paper at a printing ratio of 5%. It is removably held by a development rotary 23 that rotates about a shaft 22.

In an image forming operation, the developing devices 20Y, 20M, and 20C are orbitally moved around the shaft 22 while being held by the development rotary 23 until a predetermined developing device (20Y, 20M, and 20C) reaches a position at which the development roller of the predetermined developing device squarely faces the photosensitive drum 15, holding a microscopic gap (approximately 300 μm from the peripheral surface of photosensitive drum 15). Then, a visible image is formed on the photosensitive drum 15 according to the latent image on the photosensitive drum 15 in a full-color image forming operation, the development rotary 23 rotates once per turn of the intermediary transfer member 9, and the development processes are carried out by the yellow developing device 20Y, the magenta developing device 20M, the cyan developing device 20C, and the black developing device 21B in this order.

For example, in a state in which the developing device 20Y is standing still after having been moved to the development position where the peripheral surface of the developing device 20Y faces the photosensitive drum 15, the toner within the yet to be described toner container (FIG. 1) of the developing device 20Y is sent to the coating roller 20YR by the toner delivery mechanism, and is coated in a thin layer, while being triboelectrically charged, onto the peripheral surface of the development sleeve 20YS, which is being rotated clockwise as indicated in the drawing. The coating is done by the coating roller 20YR, which is being rotated clockwise as indicated in the drawing, and a blade 20YB which is pressed upon the peripheral surface of the development roller 20YS.

Then, development bias is applied to the development roller 20YS opposing the photosensitive drum 15 which is bearing an electrostatic latent image. As a result, a visible image is composed of toner on the photosensitive drum 15 according to the latent image. The development procedure similar to the above described one is carried out also by the magenta developing device 20M and cyan developing device 20C to develop the corresponding latent image into toner images.

As the three developing devices 20Y, 20M and 20C are orbitally moved in sequence to the development position, their development rollers 20YS, 2OMS, and 20CS come in contact with the high voltage power source for development provided on the main assembly side of the printer, and the development device driver also provided on the main assembly side of the printer. Then, a voltage is applied to the development devices to drive them.

These color developing devices 20Y, 20M and 20C are individually and removably mounted in the development rotary 23. More specifically, the development rotary 23 is provided with end plates, one at each longitudinal end, and each end plate is provided with a guiding means so that the color developing devices 20Y, 20Y, and 20C can be inserted into, or extracted from, the development rotary 23 in the radial direction of the development rotary 23.

[Intermediary Transfer Member]

The aforementioned intermediary transfer member 9 is rotationally driven in the clockwise direction indicated by an arrow mark in the drawing, at the same peripheral velocity as that of the image bearing member 15, to receive a toner image, a visual image which is formed on the image bearing member 15 by one of the development devices 20Y, 20M, 20C, and 21B, and is to be transferred onto the intermediary transfer member 9. Thus, for the formation of a single full-color image, the intermediary transfer member 9 is rotated four times (once for each of four colors Y, M, C, and Bk) to receive in layers the four toner images of different color. After the transfer in layers of the multiple toner images, a piece of transfer medium 2 is fed between the intermediary transfer member 9, and the transfer roller 10 to which a voltage is being applied, and is conveyed forward by being pinched by the two members. As the transfer medium 2 is conveyed, the toner images of different color on the intermediary transfer member 9 are transferred all at once onto the recording medium 2.

The intermediary transfer member 9 in this embodiment consists of an aluminum cylinder 12 with a diameter of 186 mm, and an elastic layer 11 coated on the peripheral surface of the aluminum cylinder 12. The material for the elastic layer 11 is sponge or rubber with an electrical resistance in an intermediary range. The intermediary transfer member 9 is rotationally supported and is rotationally driven by the driving force transmitted through an unillustrated gear fixed to one of its longitudinal ends.

[Cleaning Means]

The cleaning means is a means for removing the toner that which remains on the photosensitive drum 15 after the transfer of a visual image, that is, an image composed of toner by the developing means, on the image bearing member 15 onto the intermediary transfer member 9. The removed toner, that is, waste toner, is collected in the cleaning means housing 14. The amount of the waste toner collected in the housing 14 never becomes large enough to fill up the housing 14 before the service life of the image bearing member runs out. The cleaning means housing 14 is replaced with a fresh one, as a part of a fresh process cartridge, when a photosensitive drum with an expired service life is replaced by exchanging the old process cartridge with a fresh one.

[Sheet Conveying Means]

The sheet feeding means is a means for conveying the transfer medium 2 to the image forming section. It generally comprises a cassette 1 that holds plural sheets of transfer medium 2, a sheet feeder roller 3, a conveyer roller 4, a retarder roller 5 for preventing two or more sheets of transfer medium 2 from being fed in layers, a sheet feeder guide 6, a conveyer roller 7, a registration roller 8, and the like.

In an image forming operation, the sheet feeder roller 3 is rotationally driven in synchronism with the progress of image formation, to feed the sheets of transfer medium 2 into the main assembly of the image forming apparatus from the cassette 1, one by one while separating them. After being fed into the main assembly, the transfer sheet 2 is guided by the sheet feeder guide plate 6, and is conveyed to the registration roller 8 by way of the conveyer roller 7. The registration roller 8 is intermittently driven so that the arrival of the leading edge of the recording medium to the transfer position synchronizes with the arrival of the leading edge of a toner image formed on the image bearing member 15 to the transfer position, during a transfer process that follows the toner image formation process.

[Transfer Section]

The transfer section comprises a pivotally supported transfer roller 10. It consists of a metallic shaft and a layer of foamed elastic material wrapped around the metallic shaft, and is rotationally driven. It can be vertically moved as depicted in the drawing.

While four toner images of different color are sequentially transferred onto the peripheral surface of the intermediary transfer member 9, in other words, while the intermediary transfer member 9 is rotated a plural number of times, the transfer roller 10 remains locked in the bottom position outlined by a thick solid line, being separated from the intermediary transfer member 9.

After the transfer of the four toner images of different color onto the intermediary transfer member 9, the transfer roller 10 is moved to the top position outlined by a fine line in the drawing, by an unillustrated cam, in synchronism with the delivery of the transfer medium 2 to the transfer position, so that the transfer medium 2 is pressed upon the intermediary transfer member 9 by the transfer roller 10. While the transfer roller 10 is at the top position, bias is applied to the transfer roller 10. As a result, the toner images on the intermediary transfer member 9 are transferred onto the transfer medium 2.

Since both the intermediary transfer member 9 and the transfer roller 10 are driven independently from each other, the transfer medium 2 pinched by the two rollers is conveyed, during this transfer period, in the leftward direction indicated in the drawing, at a predetermined velocity, to a fixing device, in which the following process is carried out.

[Fixing Section]

Figures 1A, 1B:
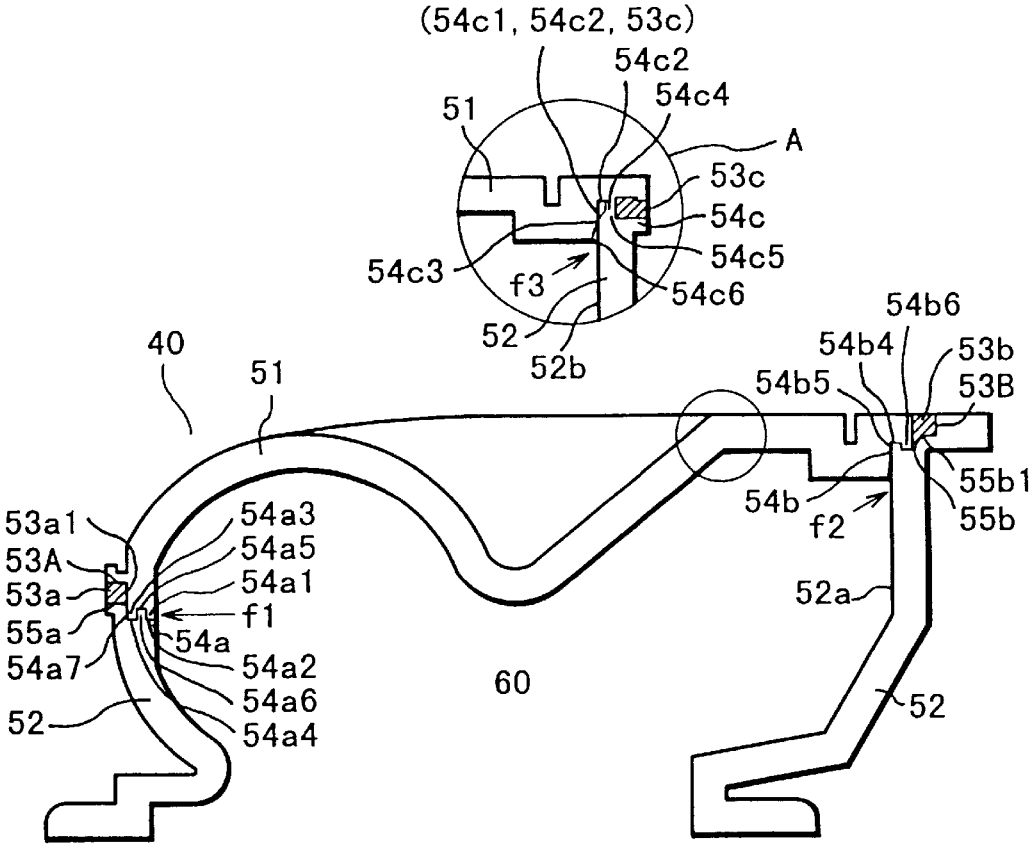
FIG. 1 is a schematic sectional view of the essential portion of one of the toner containers in accordance with the present invention.

A fixing section 25 is a section for fixing to the transfer medium 2, the toner images which have been transferred onto the transfer medium 2. As depicted in FIG. 1, it consists of a fixing roller 26 for applying heat to the transfer medium 2, and a pressure roller 27 for pressing the transfer medium 2 against the fixing roller 26. Both rollers are hollow, and contain heaters 28 and 29, respectively, and ate rotationally driven to fix the toner images while conveying the transfer medium 2. Thus, as the transfer medium 2, which holds the toner images, is conveyed by the fixing roller 26 and pressure roller 27, the toner images are fixed to the transfer medium 2 by the application of heat and pressure.

[Toner Container]

Next, referring to FIG. 1, the toner container in each of the color developing devices 20Y, 20M and 20C will be described.

Figure 4:
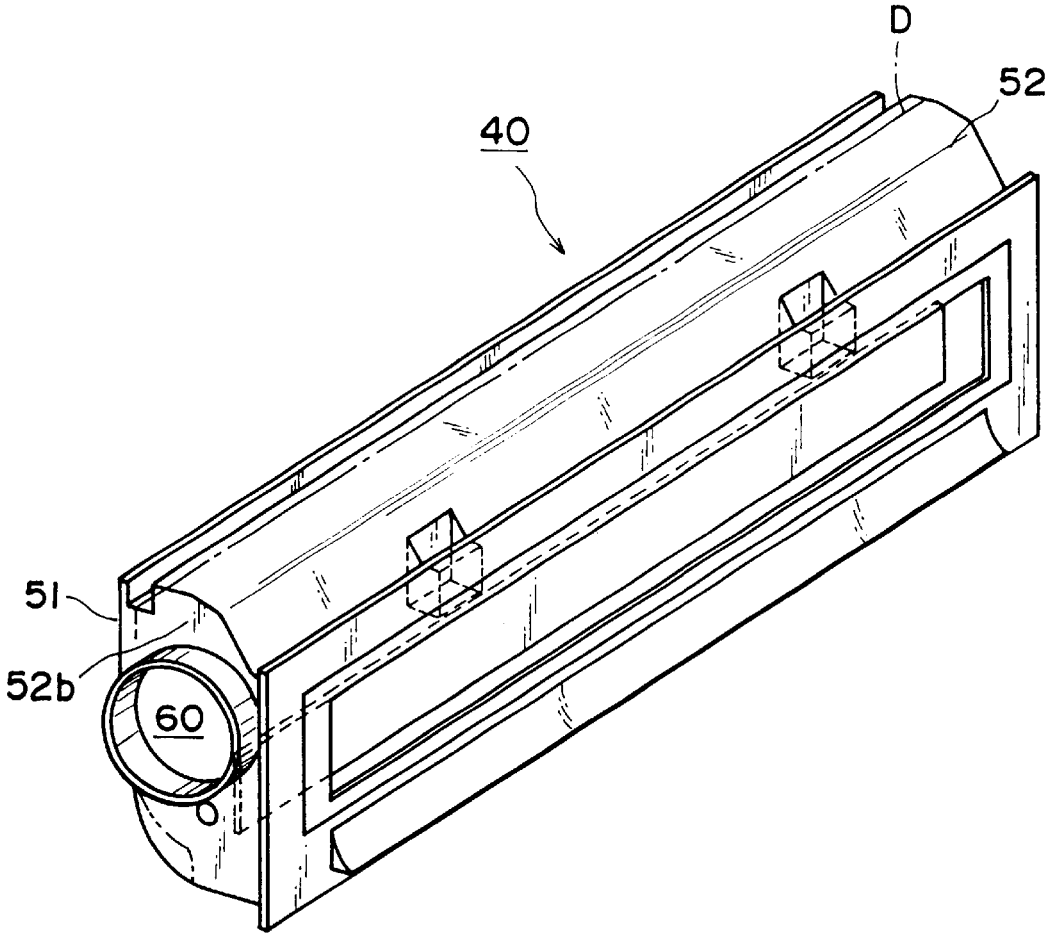
FIG. 4 is a perspective view of one of the toner containers in accordance with the present invention.

FIG. 4 is a perspective view of a toner container 40 in accordance with the present invention. It is formed by integrally joining two components with the use of meltable resin. The sizes of the two pieces may be substantially equal, or may be different. In other words, in designing a toner container, the location of the dividing line, that is, the joint line, between the two pieces relative to the entirety of the toner container may be optionally set. In this embodiment, the line designated by a reference character D is the joint line.

A space 60, or the hollow portion of the toner container 40 is filled with toner, and remains sealed until the first time a process cartridge is used.

FIG. 1 is a sectional view of the toner container 40, at a plane perpendicular to the longitudinal direction of the toner container. A portion surrounded in the drawing by a circle designated by a reference character A is a sectional view of the joint portion between the end wall and top wall of the toner container, and its adjacencies, at a plane perpendicular to the plane of the drawing in this embodiment, the joints 53*a*, 53*b*, and 53*c* between the component 51, the main piece (first sub-frame), and the component 52, the lid (second sub-frame), of the toner container 40 have the following designs, correspondingly.

(1) Shape of Cross Section of Joint 53*a*

Figure 5:
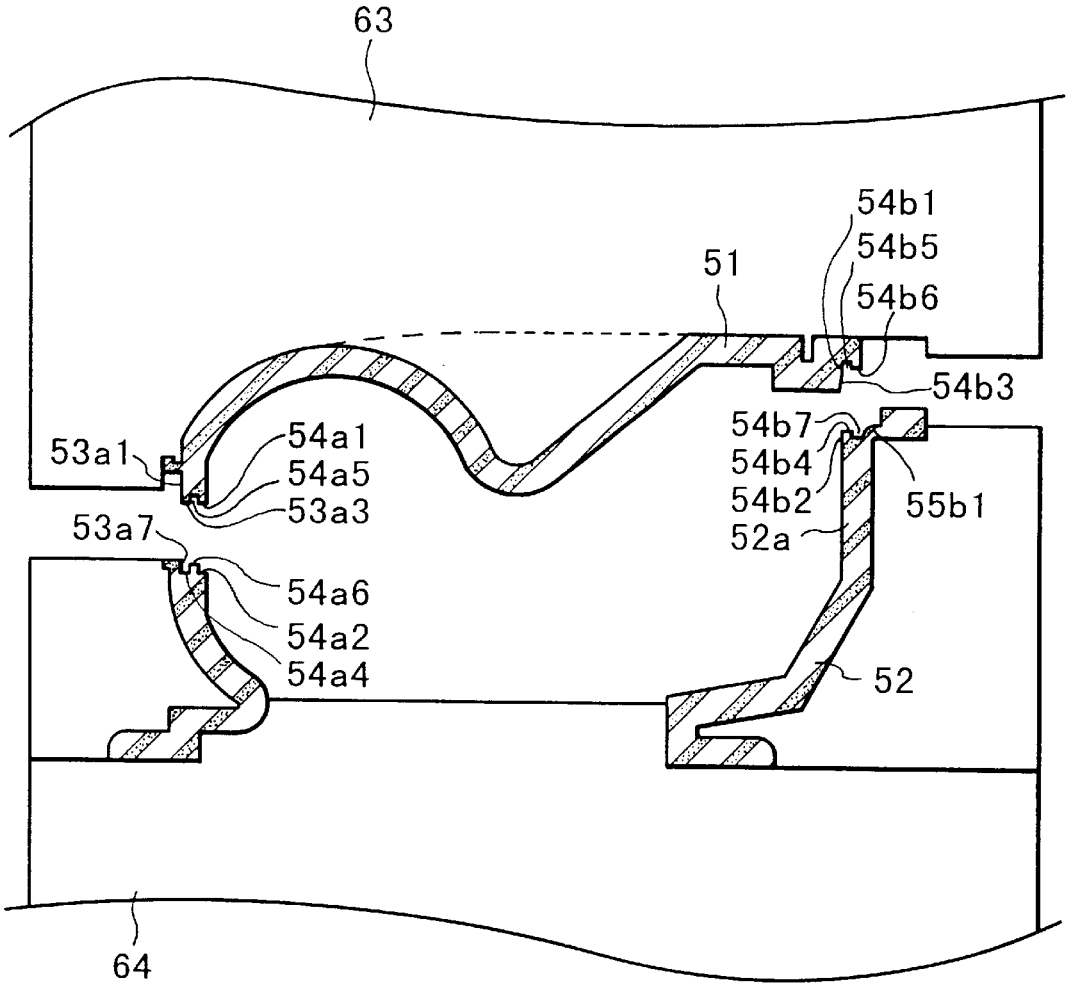
FIG. 5 is a conceptual drawing that depicts how a toner container and a toner container lid in accordance with the present invention joined together within a metallic mold.
Figures 6A, 6B:
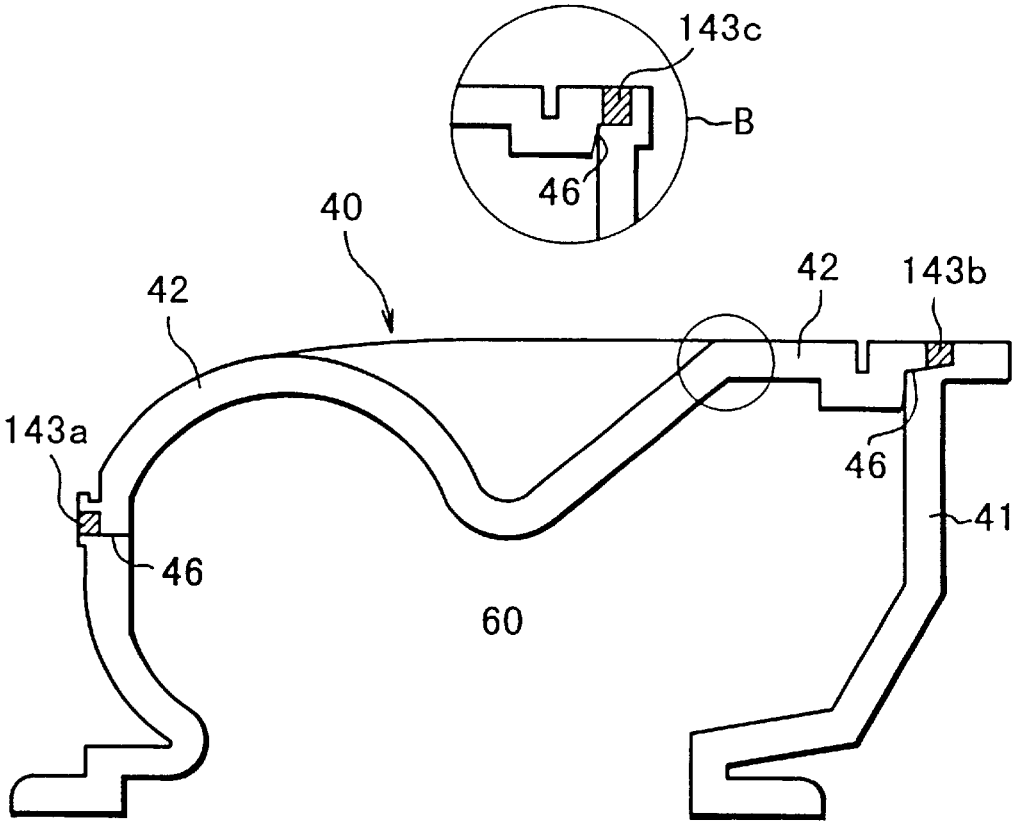
FIG. 6 is a schematic vertical sectional view of a conventional toner container.

Referring to FIGS. 1 and 5, a joint 54*a* is a part of the seam between the main piece 51 and the lid 52 (part of interface between joining surface 54*a*1 on main piece 51 side and joining surface 54*a*2 on lid 52 side). This joining surface 54*a* is on the inward side of the toner container relative to the core portion of the container wall. A reference character 53A designates a groove, which is formed as the main piece 51 and lid piece 52 are placed in contact, and in alignment, with each other to be joined together. This groove 53A is the groove into which melted adhesive resin is poured to unite the two pieces. The surface, a portion of which forms the bottom of the groove A, extends beyond the lateral surface of the groove A on the lid 52 side, and forms a joining surface 53*a*1 which joins with the joining surface 54*a*7 on the lid 52 side. Reference characters 54*a*3 and 54*a*4 are corresponding joining surfaces on the main piece 51 side and lid piece 52 side, respectively. The joining surface 54*a*3 is one of the downward facing surfaces of the main piece 51, and is perpendicular to the surface 53*a*1, that is, the extension of the bottom surface of the groove A. The joining surface 54*a*4 is one of the upward facing surfaces of the lid piece 52, and is perpendicular to the joining surface 54*a*7, that is, one of the inwardly facing surfaces of the lid piece 52. A reference character 54*a*5 designates a groove that runs in the longitudinal direction of the toner container, between the downward facing joining surfaces 54*a*1 and 54*a*3 which are on substantially the same plane. The tongue portion 54*a*6, which fits in the groove 54*a*5, projects upward from the lid piece 52. It is between the joining surfaces 54*a*2 and 54*a*4 of the lid piece 52, which is on substantially the same plane. Referring to FIG. 1, the main and lid pieces 51 and 52 must be structured so that when the two components are joined at the joint 53*a*, the joining surfaces 54*a* and 54*a*7 make perfect contact with each other. However, there may remain a slight gap between the tongue portion 54*a*6 and the groove 54*a*5 in consideration of the manufacturing process.

(2) Shape of Cross Section of Joint 53*b*

Referring to FIGS. 1 and 5, a reference character 54*b* designates another part of the seam between the main piece 51 (first sub-frame) and the lid piece 52 (second sub-frame) (another part of interface between and joining surface 54*b*2 on lid 52 side). The joining surface 54*b*2 of the lid piece 52 is the same as the inward surface of the tongue 54*b*4 that runs in the longitudinal direction of the toner container. This inwardly facing surface of the tongue 54*b*4 is the extension of the inwardly facing surface 52*a* of the lid piece 52 of the toner container. In order to make it easier for the tongue 54*b*4 of the lid piece 52 to fit into the groove 54*b*5 of the main piece 52 of the toner container, the outwardly facing surface of the main piece 51, with which the inwardly facing surface 54*b*2 (52*a*) of the lid piece 52 joins, is slanted inward, that is, in the direction to move away from the opening portion of the groove 54*b*5, forming a guiding surface 54*b*3. In other words, the inwardly facing surface of the groove 54*b*5 is the same as the joining surface 54*b*1, and the guiding surface 54*b*3 and the joining surface 54*b*1 are different portions of the same inwardly facing surface of the main piece 51. The provision of this guiding surface 54*b*3 makes it easier to fit the tongue portion of the lid piece 52 into the groove 54*b*5 of the main piece 51 while assembling the toner container.

A reference character 54*b*6 designates a tongue portion of the main piece 51. It fits in the groove 54*b*7 of the lid piece 52. The inwardly facing surface of this tongue portion 54*b*6 is the same as the inwardly facing surface of the groove 54*b*5 of the main piece 51, and the inwardly facing surface of this groove 54*b*7 is the same as the outward facing surface of the tongue portion 54*b*4 of the lid piece 52. The depth of the groove 54*b*7 is greater than the height of the tongue portion 54*b*6 of the main piece 51. Therefore, as the lid piece 52 and main piece 51 of the toner container are fitted with each other, the end surface of the tongue portion 54*b*6 of the main piece 51 comes in contact with the bottom surface of the groove 54*b*7 of the lid piece 52, but there may remain a microscopic gap between the bottom surface of the groove 54*b*5 of the main piece 51 and the end surface of the tongue portion 54*b*4 of the lid piece 52. In other words, the end portion of the tongue portion 54*b*6 of the main piece 51 and the bottom surface of the groove 54*b*7 of the lid piece 52 are the joining surfaces by which the main piece 51 and lid piece 52 of the toner container make direct contact with each other as is evident from FIG. 1, the outwardly facing surface of the tongue portion 54*b*6 and the outwardly facing surface of a groove 54B for melted adhesive resin are different portions of the same outwardly facing surface of the main piece 51.

The inwardly facing surface of the groove 54*b*7 is substantially perpendicular to the bottom surface of the groove 54*b*7, but it is rounded outward at the opening 55*b*1 of the groove, and further extends in the direction parallel to the bottom surface of the groove 54*b*7, becoming a surface 55*b* which is the same as the bottom surface of the groove 54B.

(3) Shape of Cross Section of Joint 53*c*

Referring to FIG. 1, a reference character 54*c* designates another joint between the main and lid pieces 51 and 52 of the toner container. This joint 53*c* is located at the longitudinal ends of the toner container, where the outwardly facing surface of the main piece 51, a part of which is the outwardly facing surface 54*c*1 of the groove 54*c*2 of the main piece 51, joins with the inwardly facing surface 52*b* of the lid piece 51, a part of which is the inwardly facing surface 54*c*2 of the tongue portion 54*c*3 of the lid piece 51. The inwardly facing surface of the tongue portion 54*c*4 of the main piece 51 joins with the outwardly facing surface of the groove 54*c*2 of the lid piece 52. The end portion of this tongue portion 54*c*4 of the main piece 51 makes contact with the surface 54*c*5 that extends outward from the base of the tongue portion 54*c*3 of the lid piece 52 in other words, the end surface of the tongue portion 54*c*4 of the main piece 51 and the surface 54*c*5 of the lid piece 52 are the essential joining surfaces by which the main piece 51 and lid piece 52 of the toner container squarely meet with each other. The joint portion of the main piece 51 is provided with a slanted guide portion 54*c*6 that extends from the joining surface 54*c*1. Therefore, the tongue portion 54*c*3 of the lid piece 52 easily fits into the groove 54*c*2 of the main piece 51, making it easier to assemble the toner container.

The aforementioned joints 53*a* and 53*b*, which run in the longitudinal direction of the toner container, are in connection with the joint 53*c*, which runs in the width direction of the toner container without any gap. However, there is a possibility that the melted adhesive resin might enter the toner container 40 through the joints 53*a*, 53*b*, and 53*c*. Therefore, the joining surfaces of the main and lid pieces 51 and 52 are intricately configured to complicate the interface and spaces which are created as the two pieces are joined. In other words, before the melted adhesive resin enters the toner chamber, it must go through at least four barriers: the interface sections, the edges of which appear in the grooves 53A, 53B, and 53C for the melted adhesive resin, the various bends between the two interface sections, and the interface sections, the edges of which appear in the gaps between the joining surfaces of the main and lid pieces 51 and 52. Thus, it is very difficult for the melted adhesive resin to seep into the toner chamber of the toner container 40.

As described, according to this embodiment, the joining surfaces of the toner container are provided with tongue portions and grooves that fit with each other. However, the configuration of the joining surfaces does not need to be limited to this design.

Referring to FIG. 5, in order to join the main piece 51 and lid piece 52 of the toner container to form the joints 53*a*, 53*b*, and 53*c*, the main and lid pieces 51 and 52 of the toner container are placed in the top and bottom molds 63 and 64. Then, the top and bottom molds 63 and 64 are joined, causing the main and lid pieces 51 and 52 to contact each other. As a result, gaps, that is, the aforementioned grooves 53A, 53B, and 53C, are created at the joints 53*a*, 53*b*, and 53*c*. Then, the melted adhesive resin is poured into these gaps.

As is evident from the description given above and the related drawings, the toner container in this embodiment is a toner container that is used in an electrophotographic image forming apparatus to hold toner. It comprises; a plastic first piece 51 (main component) with joining surfaces, and a plastic second piece 52 (lid) with joining surfaces. The joining surfaces of the first and second pieces 51 and 52 are placed, and kept, in contact with each other, at the joints 53*a*, 53*b*, and 53*c*, with the use of the melted adhesive resin poured into the grooves 53A, 53B, and 53C which are formed as the joining surfaces of the main piece 51 are placed in contact with the corresponding joining surfaces of the lid piece 52. Further, the joining surface of the first piece 51 is provided with the grooves 54*b*5, 54*c*2, and 54*c*2, and the joining surface of the second piece 51 is provided with the tongue portions 54*a*6, 54*b*4, and 54*c*3 that fit into the corresponding grooves of the joining surface of the fist piece 51. As is evident from the drawings, the interface, or seam, between the first and second pieces 51 and 52 forms a labyrinth. The aforementioned tongue-and-groove portions of the joints are located inward of the core portion of the toner container wall. The opening of each groove into which the melted adhesive resin is poured to bond the first and second pieces 51 and 52 of the toner container faces outward of the toner container. Each of the joints at which the first and second pieces 51 and 52 of the toner container are bonded to each other is such a joint that comprises a groove, which is created as the first and second pieces 51 and 52 are placed in contact with each other, and in which the melted adhesive resin is poured to bond the two pieces.

The toner container in this embodiment comprises two plastic pieces, that is, first (main) and second (lid) pieces formed by injection molding. The two pieces are bonded together at the joints 53*a*, 53*b*, 53*c* by placing them in the molds prepared specifically for the first and second pieces, and pouring the melted adhesive resin into the grooves 53A, 53B, and 53C formed at the corresponding joints 53*a*, 53*b*, and 53*c*. The toner container in this embodiment is designed so that the planes of the inwardly facing joining surfaces 54*a*, 54*b*, and 54*c* of the first and second pieces 51 and 52 of the toner container do not coincide with the planes of the outwardly facing joining surfaces 55*a*, 55*b*, and 55*b*, the portions of which form the bottom surfaces of the grooves into which the melted adhesive resin is directly poured. Therefore, even if the toner container is subjected to the internal pressure changes, and/or the shocks caused by the sudden movement of the toner, which occur during shipment or as the container is dropped, the shearing forces f1, f2, and f3 which the pressure changes and/or the shocks create do not directly apply to the interface, that is, the seam. Therefore, the first (main) and second (lid) pieces 51 and 52 do not separate from each other at their interface; the toner container does not break. The material for the main and lid pieces, inclusive of joint portions 53*a*, 53*b*, and 53*c*, of the toner container is resin, more specifically, a mixture of shock-resistant polystyrene (RI-PS), and flame retardant for giving the mixture a flame retardation grade of V2. The ratio between the HI-PS, which is styrene group resin reinforced with rubber, and the flame retardant is 100 parts in weight to 3–20 parts in weight. More specifically, the flame retardant is a chemical compound sold by ALBEMARLE CORPORATION under the name of Saytex 8010. Its chemical name is ethylene-bisbromobenzene (designated by a reference number 61 in FIG. 7 and FIG. 8, (b)), and its structural formula is given below:

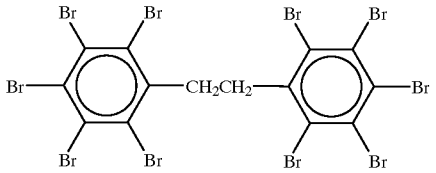

Figure 8:
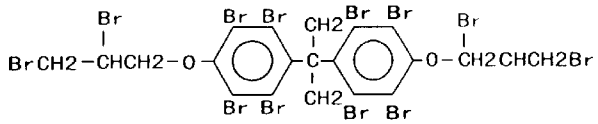
FIG. 8 is a table that comparatively presents the characteristics of the conventional flame retardant and the flame retardant in accordance with the present invention.
Figure 8:
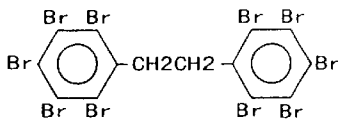

The above described flame retardant designated by the reference number 62 in FIG. 7 and FIG. 8, (b) is superior to the conventional flame retardant, for example, derivative of tetrabromobisphenol, that is, bi (dibromopropyl)-tetrabromobisphenol A ether, designated by a referential number 61 in FIG. 7 and FIG. 8, (a), in terms of thermal stability. In other words, the amount of the gas generated when the former is used is drastically smaller compared to when the latter is used. Therefore, the usage of the former prevents the effectiveness, or the adhesive force, of the adhesive resin from being reduced by the bubbles formed by the above described gas at the interface. In other words, the usage of the flame retardant in this embodiment drastically improves the strength of the joints compared to the conventional flame retardant.

Further, when the toner container material in accordance with the present invention is used, the temperature of the melted adhesive resin can be set higher than when the conventional toner container material is used (220° C. for conventional material, and 240–280° C. for material in this embodiment). Thus, the adhesive resin in this embodiment flows more smoothly into the small grooves (for example, cross section of groove is 1–5 mm×1–5 mm) for the adhesive, uniformly filling the grooves along their entire length, as it is poured into the grooves that go around the toner container along the contact portions, because the setting of the temperature of the toner container material higher, increases the fluidity of the HI-PS.

In this embodiment, the present invention was described with reference to a toner container, which is a part of a developing device. However, the present invention is also applicable to a toner container, which is independent from a developing device and is removably installable in the main assembly of an image forming apparatus, a toner container that doubles as one of the structural components of a process cartridge, and the like. The present invention is also applicable to a process cartridge that is removably installable in the main assembly of an image forming apparatus, and that comprises a waste toner container that consists of a cleaning means housing portion and a waste toner chamber portion.

As described above, the toner container in this embodiment described above is designed so that it can be formed by bonding two plastic components, which are formed by injection molding, to each other by pouring melted adhesive resin into the grooves formed at the joints between the two components as the two components are properly placed in contact with each other for assembly, and so that the planes of the inwardly facing joining surfaces of the two components do not coincide with the planes of the corresponding outwardly facing surfaces of the two components, a portion of each of which constitutes the bottom surface of the groove into which adhesive resin is directly poured.

Further, the present invention is also applicable to a cleaning apparatus, which is removably installable in the main assembly of an image forming apparatus, and which comprises a cleaning member for removing the toner remaining on an electrophotographic photosensitive member after image transfer, a waste toner bin for holding, as waste toner, the toner removed from the electrophotographic photosensitive member by the cleaning member, and a cleaning means housing for supporting the cleaning member and holding the waste toner; wherein the cleaning means housing is designed so that it can be formed by bonding two plastic components, which are formed by injection molding, to each other by pouring melted adhesive resin into the grooves formed at the joints between the two components as the two components are properly placed in contact with each other for assembly, and so that the planes of the inwardly facing joining surfaces of the two components do not coincide with the planes of the corresponding outwardly facing surfaces of the two components, a portion of each of which constitutes the bottom surface of the groove into which adhesive resin is directly poured.

The present invention is also applicable to a developing device, which is removably installable in the main assembly of an image forming apparatus, and which comprises a developing member for developing a latent image on an electrophotographic photosensitive member with the use of toner, and a toner container for holding the toner to be supplied to the developing member; wherein the toner container is designed so that it can be formed by bonding two plastic components, which are formed by injection molding, to each other by pouring melted adhesive resin into the grooves formed at the joints between the two components as the two components are properly placed in contact with each other for assembly, and so that the planes of the inwardly facing joining surfaces of the two components do not coincide with the planes of the corresponding outwardly facing surfaces of the two components, a portion of each of which constitutes the bottom surface of the groove into which adhesive resin is directly poured.

Further, the present invention is applicable to a process cartridge, which is removably installable in the main assembly of an image forming apparatus, and which comprises an electrophotographic photosensitive member, a developing member for developing a latent image on an electrophotographic photosensitive member with the use of toner, and a toner container for holding the toner to be supplied to the developing member; wherein the toner container is designed so that it can be formed by bonding two plastic components, which are formed by injection molding, to each other by pouring melted adhesive resin into the grooves formed at the joints between the two components as the two components are properly placed in contact with each other for assembly, and so that the planes of the inwardly facing joining surfaces of the two components do not coincide with the planes of the corresponding outwardly facing surfaces of the two components, a portion of which constitutes the bottom surface of the groove into which adhesive resin is directly poured.

Further, the present invention is applicable to a process cartridge, which is removably installable in the main assembly of an image forming apparatus, and which comprises a cleaning apparatus which is removably installable in the main assembly of an image forming apparatus, and which comprises a cleaning member for removing the toner remaining on an electrophotographic photosensitive member after image transfer, a waste toner bin for holding, as waste toner, the toner removed from the electrophotographic photosensitive member by the cleaning member, and a cleaning means housing for supporting the cleaning member and holding the waste toner; wherein the cleaning means housing is designed so that it can be formed by bonding two plastic components, which are formed by injection molding, to each other by pouring melted adhesive resin into the grooves formed at the joints between the two components as the two components are properly placed in contact with each other for assembly, and so that the planes of the inwardly facing joining surfaces of the two components do not coincide with the planes of the corresponding outwardly facing surfaces of the two components, a portion of which constitutes the bottom surface of the groove into which adhesive resin is directly poured.

As is evident from the above description of the embodiment of the present invention, the toner container in this embodiment is designed so that the planes of the inwardly facing joining surfaces 54*a*, 54*b*, and 54*c* of the two components of the toner container do not coincide with the planes of the outwardly facing joining surfaces, the portions of which form the bottom surfaces of the grooves into which the melted adhesive resin is directly poured. Therefore, even if the toner container is subjected to the internal pressure changes, and/or the shocks caused by the sudden movement of the toner, which occur during shipment or as the container is dropped, the shearing forces which the pressure changes and/or the shocks create do not directly apply to the interface. Therefore, the two components do not separate from each other at their interface after the bonding; the toner container does not break. The material for the two components, and the adhesive resin for bonding the two components are shock-resistant polystyrene (HI-PS) with a flame retardation grade of V2.

Further, the above described flame retardant designated by the referential number 62 in FIG. 7 and FIG. 8, (b) is superior to the conventional flame retardant, for example, derivative of tetrabromobisphenol, that is, his (dibromopropyl)-tetrabromobisphenol A ether, designated by a referential number 61 in FIG. 7 and FIG. 8, (a), in terms of thermal stability. In other words, the amount of the gas generated when the former is used is drastically smaller compared to when the latter is used. Therefore, the usage of the former prevents the effectiveness, or the adhesive forces of the adhesive resin from being reduced by the bubbles formed by the above described gas at the interface. Thus, the usage of the flame retardant in this embodiment drastically improves the strength of the joints compared to the conventional flame retardant.

As described above, the present invention can improve the adhesion between the corresponding the joining surfaces of two or more components of a toner container or the like.

While the invention has been described with reference to the structures disclosed herein, it is not confined to the details set forth, and this application is intended to cover such modifications or changes as may come within the purposes of the improvements or the scope of the following claims.

What is claimed is:

1. A toner container usable with an image forming apparatus, for containing toner, said toner container comprising:

a first frame of resin material;

a second frame of resin material;

a bonding portion where said first and second frames are connected with each other by bonding material, said bonding portion being provided at an outer surface of said toner container; and a fitting portion provided inside said bonding portion adjacent said bonding portion, where a projection provided in said second frame is fitted into a pit provided in said first frame.

2. A toner container according to claim 1, wherein said fitting portion has a labyrinth-like shape.

3. A toner container according to claim 1, wherein said bonding material is molten resin material and is injected with said first and second frames being abutted to each other in a mold.

4. A toner container according to claim 1, 2, or 3, wherein said first and second frames are produced by injection molding of polystyrene material.

5. A toner container according to claim 4, wherein said polystyrene has UL flame-resistivity V2 grade.

6. A toner container according to claim 4, wherein the polystyrene comprises 100 parts by weight of rubber reinforced styrene resin material and 3 to 20 parts by weight of flame retardant agent, and has the following structural formula:

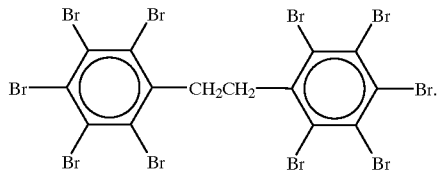

7. A toner container according to claim 1, wherein said toner container is for containing toner for developing a latent image formed on an electrophotographic photosensitive member.

8. A toner container according to claim 1, wherein said toner container supports a cleaning member for removing residual toner remaining on an electrophotographic photosensitive member, said toner container accommodates the toner removed by said cleaning member, wherein said toner container constitutes a cleaning container.

9. A developing cartridge for developing a latent image formed on a photosensitive member, said developing cartridge being detachably mountable to a main assembly of an image forming apparatus, said developing cartridge comprising:

(a) a developing member for developing a latent image formed on the photosensitive member;

(b) a toner container for containing toner to be used for developing the latent imbue by said developing member, said toner container including:

a first frame of resin material;

a second frame of resin material;

a bonding portion where said first and second frames are connected with each other by bonding material, said bonding potion being provided at an outer surface of said toner container; and a fitting portion provided inside said bonding portion adjacent said bonding portion, where a projection provided in said second frame is fitted into a pit provided in said first frame.

10. A developing cartridge according to claim 9, wherein said fitting portion has a labyrinth-like shape.

11. A developing cartridge according to claim 9, wherein said bonding material is molten resin material and is injected with said first and second frames being abutted to each other in a mold.

12. A developing cartridge according to claim 9, 10 or 11, wherein said first and second frames are produced by injection molding of polystyrene material.

13. A developing cartridge according to claim 12, wherein said polystyrene has UL flame-resistivity V2 grade.

14. A developing cartridge according to claim 12, wherein the polystyrene comprises

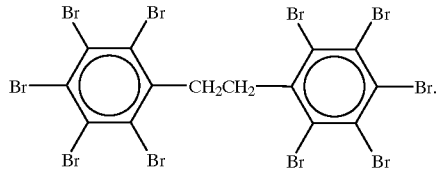

15. A process cartridge detachably mountable to a main assembly of an image forming apparatus, comprising:

(a) a photosensitive member:

(b) process means actable on said photosensitive member;

(c) a cartridge frame;

said cartridge frame including:

a first frame of resin material;

a second frame of resin material;

a bonding portion where said first and second frames are connected with each other by bonding material, said bonding portion being provided at an outer surface of said toner container; and a fitting portion provided inside said bonding portion adjacent said bonding portion, where a projection provided in said second frame is fitted into a pit provided in said first frame.

16. A process cartridge according to claim 15, wherein said cartridge frame constitutes a toner container for containing toner for developing a latent image formed on an electrophotographic photosensitive member.

17. A process cartridge according to claim 15, wherein said toner container supports a cleaning member, as said process means, for removing residual toner remaining on an electrophotographic photosensitive member, said toner container accommodates the toner removed by said cleaning member, wherein said toner container constitutes a cleaning container.

18. A process cartridge according to claim 17, wherein said fitting portion has a labyrinth-like shape.

19. A process cartridge according to claim 17, wherein said fitting portion is disposed inner side than said bonding portion.

20. A process cartridge according to claim 17 or 18, wherein said first and second frames are produced by injection molding of polystyrene material.

21. A process cartridge according to claim 20, wherein said polystyrene has UL flame-resistivity V2 grade.

22. A process cartridge according to claim 20 or 21, wherein the polystyrene comprises

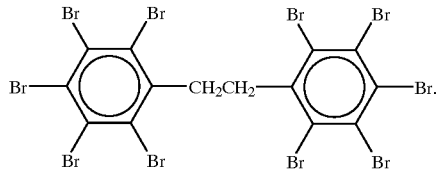

23. A process cartridge according to claim 1, wherein said process means includes at least a developing member for developing a latent image formed on the electrophotographic photosensitive member, a charging member for charging said electrophotographic photosensitive member and a cleaning member for removing residual toner remaining on said electrophotographic photosensitive member.

24. A toner container according to claim 1, wherein said bonding material is not applied to said fitting portion.

25. A cartridge according to claim 9, wherein said bonding material is not applied to said fitting portion.

26. A process cartridge according to claim 15, wherein said bonding material is not applied to said fitting portion.

27. A toner container usable with an image forming apparatus, for containing toner, said toner container comprising:

a first frame of resin material;

a second frame of resin material; and a bonding portion where said first and second frames are connected with each other by bonding material;

wherein said bonding material comprises 100 parts by weight of styrene resin material and 3 to 20 parts by weight of flame retardant agent, and the flame retardant agent has the following structural formula:

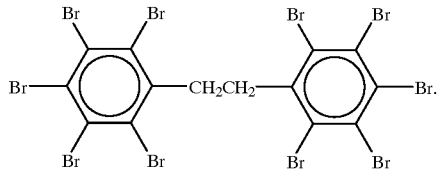

28. A toner container according to claim 26, wherein said bonding material comprises polystyrene resin material, and wherein said polystyrene has UL flame-resistivity V2 grade.

29. A toner container according to claim 27 or 28, wherein said first frame and said second frame are made of the same material as said bonding material.

30. A toner container according to claim 27, wherein said bonding portion is provided at an outer surface of said toner container, and a contact portion where said first frame and said second frame are contacted to each other is inside of said bonding portion adjacent said bonding portion.

31. A toner container according to claim 27, wherein said bonding material is molten resin material and is injected with said first and second frames being abutted to each other in a mold.

32. A toner container according to claim 27, wherein said toner container is provided in a developing apparatus for developing an electrostatic image formed on a photosensitive member with toner.

33. A toner according to claim 32, wherein said photosensitive member and said developing apparatus are provided in a process cartridge which is detachably mountable to a main assembly of an image forming apparatus.

* * * * *

UNITED STATES PATENT AND TRADEMARK OFFICE

CERTIFICATE OF CORRECTION

PATENT NO. : 6,246,853 B1
DATED : June 12, 2001
INVENTOR(S) : Ajura Suzuki et al.

It is certified that error appears in the above-identified patent and that said Letters Patent is hereby corrected as shown below:

Column 5,
Line 49, "20Y, 20Y, and 20C" should read -- 20Y, 20M and 20C --.

Column 6,
Line 16, "which" should be deleted.

Column 7,
Line 21, "ate" should read -- are --.
Line 50, "drawing in" should read -- drawing. In --.

Column 9,
Line 2, "other" should read -- other. --.
Line 3, "as is" should read -- As is --.
Line 28, "52 in" should read -- 52. In --.

Column 10,
Line 7, "comprises;" should read -- comprises: --.
Line 21, "fist" should read -- first --.
Line 60, "(RI-PS)," should read -- (HI-PS), --.

Column 11,
Line 16, "referential" should read -- reference --.

Column 13,
Line 32, "his" should read -- bis --.

Signed and Sealed this

Eighth Day of October, 2002

*Attest:*

*Attesting Officer*

JAMES E. ROGAN
*Director of the United States Patent and Trademark Office*